US009104146B2

(12) United States Patent
Gotoda

(10) Patent No.: US 9,104,146 B2
(45) Date of Patent: Aug. 11, 2015

(54) SHEET SEPARATING MECHANISM

(71) Applicant: AVISION INC., Hsinchu (TW)

(72) Inventor: Katsuhiko Gotoda, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/246,125

(22) Filed: Apr. 6, 2014

(65) Prior Publication Data

US 2015/0198916 A1 Jul. 16, 2015

(30) Foreign Application Priority Data

Jan. 14, 2014 (TW) ..... 103200772 U

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/2085; G03G 2215/2032; G03G 15/2053; G03G 2215/0132
USPC ..... 399/323
See application file for complete search history.

(56) References Cited

U.S. PATENT DOCUMENTS

| | | | | |
|---|---|---|---|---|
| 2003/0016971 | A1* | 1/2003 | Kikuchi et al. | 399/323 |
| 2004/0126157 | A1* | 7/2004 | Coleman et al. | 399/323 |
| 2005/0220506 | A1* | 10/2005 | Nakayama | 399/323 |
| 2010/0040397 | A1* | 2/2010 | Gorrell et al. | 399/323 |
| 2011/0188905 | A1* | 8/2011 | Shinkawa et al. | 399/323 |
| 2012/0045260 | A1* | 2/2012 | Yamamoto et al. | 399/323 |

FOREIGN PATENT DOCUMENTS

JP 2009288692 A * 12/2009

* cited by examiner

*Primary Examiner* — Francis Gray

(57) ABSTRACT

A sheet separating mechanism is provided to solve the problem that a sheet processed by heating step is easy to stick with surface of the heating roller. The sheet separating mechanism according to the present invention applies combination of contactless separating structure and contact-type separating structure to reduce the cost and manufacture process of contact part. Besides, the sheet separating mechanism can decrease the probability of the heating roller damaged by the contact-type separating structure, so as to increase the usage life of the heating roller.

21 Claims, 5 Drawing Sheets

(A)

(B)

(A)

(B)

SHEET SEPARATING MECHANISM

CROSS-REFERENCE TO RELATED APPLICATION

This application claims the benefit of Taiwan Patent Application No. 103200772, filed on Jan. 14, 2014, in the Taiwan Intellectual Property Office, the disclosure of which is incorporated herein in its entirety by reference.

BACKGROUND OF THE INVENTION

1. Field of the Invention

The present invention generally relates to a sheet separating mechanism, more particularly, to a sheet separating mechanism capable of separating the sheet stuck with the heating roller to prevent the sheet from being involved into the production apparatus, resulting in failure of the production apparatus.

2. Description of the Related Art

Toner heating technology is a technology of melting coatings, such as toner or printing ink, to attach on the surface of a media by high temperature and high pressure, and can be applied on printing process of business machine and the transferring process for cloth pattern. However, the printed media frequently becomes curl or is stuck with the heating or pressurizing device during heating and pressurization, so subsequent processes will be affected or jam happens in the channel of the production apparatus. This problem makes inconvenience in use of printer.

What is need is a sheet separating mechanism capable of improving defects of prior art and promoting industrial applicability.

SUMMARY OF THE INVENTION

Therefore, it is a primary objective of the present invention to provide a sheet separating mechanism which adopts the combination of contact-type separating structure and contactless separating structure to reduce manufacturing cost of components and simplify process.

To solve the problem in prior art, another objective of the present invention is to provide a sheet separating mechanism which adopts the combination of different separating structure to decrease the probability of scratched damage caused by total contact-type separating structures, so that usage life of heating roller can be extended.

To achieve the foregoing objective, the present invention provides a sheet separating mechanism disposed on an output direction of a heating roller of production apparatus. The sheet separating mechanism comprises a body, a contactless separating structure and a contact-type separating structure. The body is positioned inside the production apparatus, and the contactless separating structure is disposed on the body and spaced from heating roller by a preset distance. The contact-type separating structure comprises a connecting part and a contact part. The connecting part is connected with the body, and the contact part touches the heating roller directly. When being driven by rotation of the heating roller, a sheet is to touch the contact part or the contactless separating structure so that the sheet and the heating roller are separated.

Preferably, the contact part and the connecting part are assembled, or formed integrally.

Preferably, the material of the contact part is a thermal resistance polymer material including polyimide (PI) or polyphenylene sulfide (PPS).

Preferably, when the contact part and the connecting part are integrally formed, the thermal resistance polymer material is covered on the surface of the contact part.

Preferably, when the contact part and the connecting part are integrally formed, the material of the contact part and the connecting part are thermal resistance polymer material including polyimide (PI) or polyphenylene sulfide (PPS).

Preferably, the preset distance is ranged from 0.2 millimeter to 1.0 millimeter.

Preferably, the sheet touches the contact part and the contactless separating structure in sequence along an output direction.

Preferably, the sheet comprises a paper sheet, a slide or a cloth.

Preferably, the production apparatus may comprise a business machine or a transfer machine.

To achieve the foregoing objective, the present invention further provides a sheet separating mechanism disposed on an output direction of a heating roller of production apparatus. The sheet separating mechanism comprises a contactless separating structure and a contact-type separating structure. The contactless separating structure is formed by extending from a casing of the production apparatus, and is spaced from the heating roller by a preset distance. The contact-type separating structure comprises a connecting part and a contact part, the connecting part is formed by extending form the casing, the contact part is connected with the connecting part and directly touch the heating roller. When being driven by rotation of the heating roller, the sheet is to touch the contact part or the contactless separating structure so that the sheet and the heating roller are separated.

Preferably, the contact part and the connecting part are assembled, or formed integrally.

Preferably, the material of the contact part is a thermal resistance polymer material including polyimide (PI) or polyphenylene sulfide (PPS).

Preferably, when the contact part and the connecting part are integrally formed, the thermal resistance polymer material is covered on the surface of the contact part.

Preferably, when the contact part and the connecting part are integrally formed, the material of the contact part and the connecting part are thermal resistance polymer material including polyimide (PI) or polyphenylene sulfide (PPS).

Preferably, the preset distance is ranged from 0.2 millimeter to 1.0 millimeter.

Preferably, the sheet touches the contact part and the contactless separating structure in sequence along an output direction.

Preferably, the sheet comprises a paper sheet, a slide or a cloth.

Preferably, the production apparatus may comprise a business machine or a transfer machine.

The objective of the present invention is to provide a sheet separating mechanism which has numerous advantages as follows while maintaining its original functions.

The first advantage is cost reduction. The combination of the contact-type separating structure and contactless separating structure can decrease the number of required contact-type separating structure, so that the manufacturing cost of components may be minimized. And the quantity of required thermal resistance polymer material can further be reduced.

The second advantage is usage life extension. The combination of different separating structures can be adopted to decrease probability of scratched damage on surface of the heating roller caused by whole contact-type separating structure, so as to extend usage life of important component, such as heating roller.

The third advantage is easy repair. It is easy for user to do initial trouble cleaning because the contact-type separating structure prevents efficiently the sheet from being involved into the apparatus.

The fourth advantage is efficiency improvement. The combination of different separating structures separates the sheet stuck with the heating roller effectively, so that the time consumption for repair can be reduced.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

Figure 1:
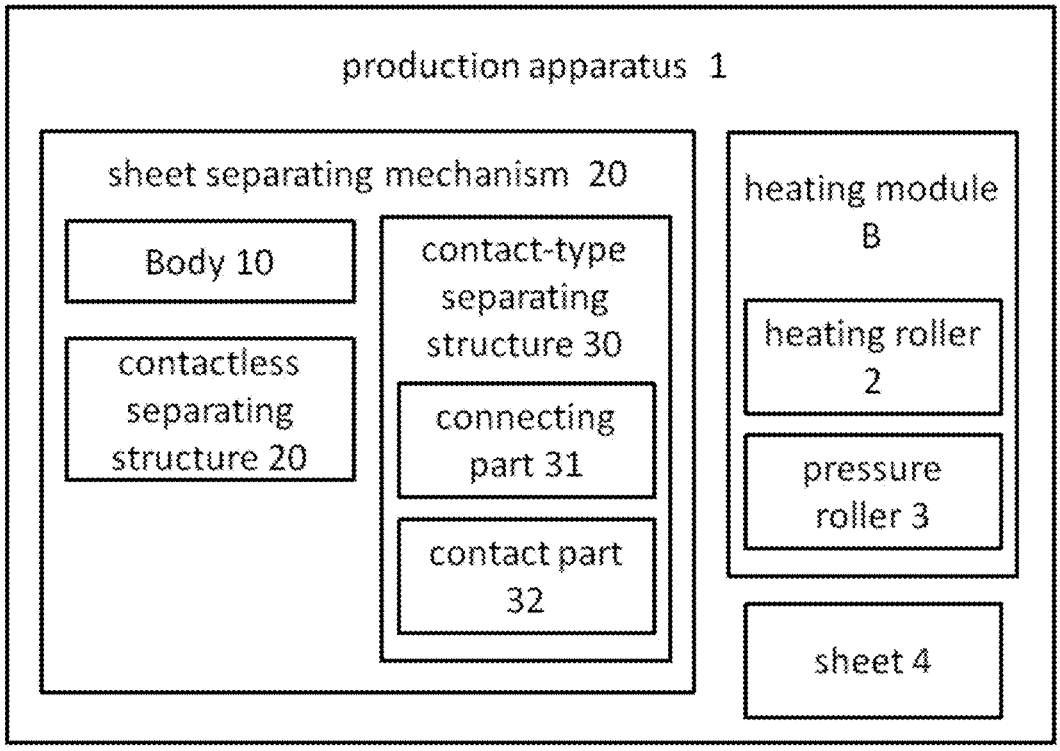
FIG. 1 is a block view of a sheet separating mechanism in accordance with the present invention.

Those skilled in the art will understand that since elements shown in the accompanying drawings may be scaled up or down for convenience in description, the present invention is not constrained to the size or shape of the elements illustrated in the drawings, rather various variations and other equivalent embodiments are also contemplated.

Hereinafter, embodiments will be described more fully with reference to the accompanying drawings, in which exemplary embodiments of the invention are shown. However, they may be embodied in many different forms and should not be construed as limited to the exemplary embodiments set forth herein. Rather, these embodiments are provided so that this disclosure will be thorough and complete, and will fully convey the scope of the invention to those skilled in the art. The terminology used herein is for the purpose of describing particular embodiments only and is not intended to be limiting of the invention.

Figure 2:
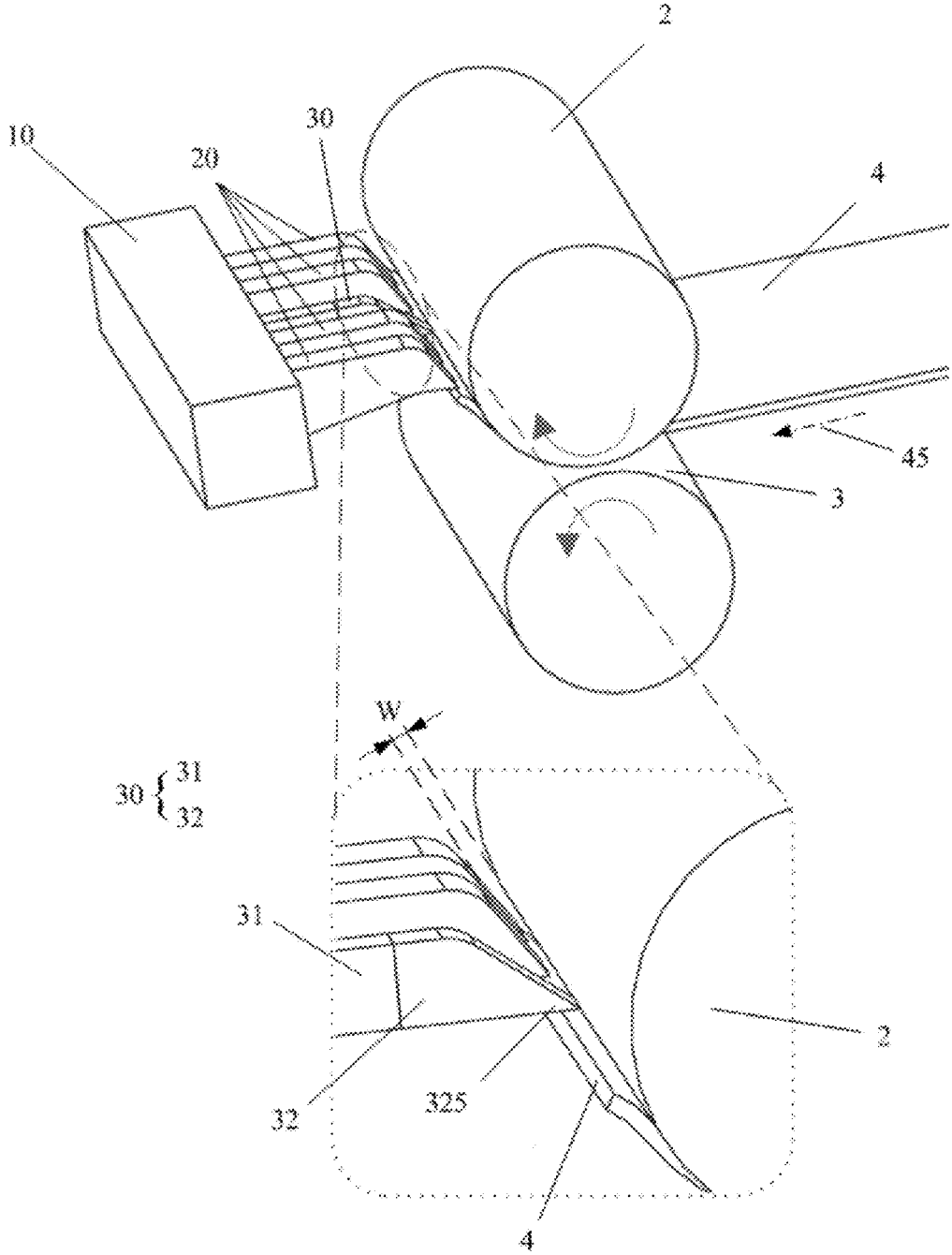
FIG. 2 is a schematic view of a sheet separating mechanism in accordance with the present invention.
Figure 3:
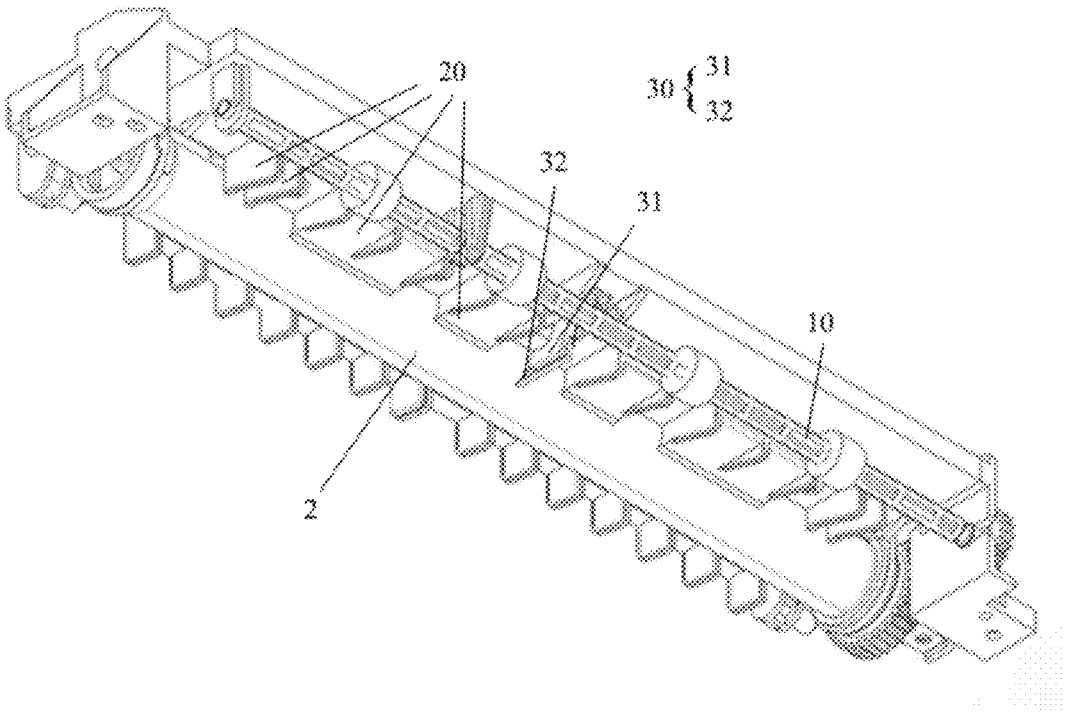
FIG. 3 is a perspective view of a sheet separating mechanism in accordance with the present invention.

Please refer to FIG. 1, FIG. 2 and FIG. 3. FIG. 1 is a block view of a sheet separating mechanism in accordance with the present invention, FIG. 2 is a schematic view of the sheet separating mechanism in accordance with the present invention, and FIG. 3 is a perspective view of the sheet separating mechanism in accordance with the present invention. In a production apparatus 1, such as a business machine or a transfer machine, the coatings including toner or printing ink is melt and attached on the sheet 4 by a fixing process executed by a heating module B in high temperature and high pressure. The heating module B comprises a heating roller 2 and a pressure roller 3, and the sheet 4 is delivered along an output direction 45 by friction of rotation of the heating roller 2 and pressure roller 3. The output direction 45 is a direction in which the sheet 4 moves by driven by the roller. For example, please refer to FIG. 2, when the heating roller 2 rotates clockwise and the pressure roller 3 rotates countclockwise, the sheet 4 is driven to move, and its movement direction is defined as the output direction 45. The sheet 4 is a media which can be attached with coatings including toner or printing ink, for example, the media includes, but not limited to, paper sheet, slide or cloth.

For example, when the sheet 4 is too slight or non-uniform thickness, it easily becomes deformed or curls during fixing process by the heating module B. Besides, when the paper sheet is affected with damp, the coatings loaded on the surface of the paper sheet is not easy to fix on such paper sheet causing such paper sheet stuck with the heating roller easily. If the sheet 4 and the heating roller 2 do not be separated in time and the stuck sheet 4 is involved into the heating module B, it causes that the production apparatus 1 fails to action and need to be stopped for repair or trouble cleaning.

To solve above mentioned problem, the sheet separating mechanism A according to the present invention can effectively separate the stuck sheet 4 from surface of the heating roller 2. Therefore, the probability that the sheet 4 is involved into heating module B can be decreased efficiently. The sheet separating mechanism A is disposed on the output direction 45 of the heating roller 2 of the production apparatus 1. The sheet separating mechanism A comprises a body 10, the contactless separating structure 20 and the contact-type separating structure 30. The body 10 is served as a base for connecting with the contactless separating structure 20 and the contact-type separating structure 30, and the body 10 is connected with the production apparatus 1 in various assembly manners. The contactless separating structure 20 is disposed on the body 10, and is spaced from the heating roller 2 by a preset distance W. Preferably, the preset distance W is ranged from 0.2 millimeter to 1.0 millimeter. In this embodiment, the contactless separating structure 20 and the contact-type separating structure 30 are independently connected to the body 10. Also, the contactless separating structure 20 and the contact-type separating structure 30 are directly connected to the body 10 respectively.

Further, the contactless separating structure 20, which is spaced from the heating roller 2 by a preset distance W, has the following advantages. First, the contactless separating structure 20 does not touch the high temperature area of the heating roller 2 directly. So there are more available materials which could be provided for the contactless separating structure 20, and the cost of components can further be reduced selectively. The common available material includes composite material such as Fiber Reinforce Polyethylene terephthalate (FR-PET) or Glass Fiber (PET-GF). Second, the preset distance W can be fine-tuned based on thickness of the sheet 4, so as to improve the separation efficiency of the contact-type separating structure 30. Moreover, the contactless separating structure 20 may be a single structure or combination of several separating structures, and the distance between the several contactless separating structures 20 can be adjusted upon demand, in order to achieve the best cost benefit. To avoid the thermal expansion effect, a plurality of the contactless separating structure 20 spaced 0~20 millimeter therebetween are implemented in this embodiment, but it is not limited to, as shown in FIG. 3.

The contact-type separating structure 30 has a connecting part 31 and a contact part 32. The connecting part 31 is connected with the body 10, and tip part 325 of the contact part 32 contacts the heating roller 2. Because the contact part 32 touches to the heating roller 2 directly, its material must be a thermal resistance polymer material 326 preferably including, but not limited to, polyimide (PI) or polyphenylene sulfide (PPS). This material has advantages of wide applicable temperature, chemical corroding resistance and high strength.

The contact part 32 and the connecting part 31 can be components produced separately and then be assembled together; or the contact part 32 and the connecting part 31 can be integrally formed by injection molding. When the contact part 32 and the connecting part 31 are integrally formed, their material can be the thermal resistance polymer material 326; or the thermal resistance polymer material 326 is just covered on the surface of tip part 325 of the contact part 32, for reducing the cost of using thermal resistance polymer material 326. When the contact part 32 and the connecting part 31 are formed by assembly, only the material of the contact part 32 is the thermal resistance polymer material 326 for minimizing the cost of using the thermal resistance polymer material 326.

The contact-type separating structure 30 can efficiently block the sheet 4 from being involved into the heating module B. Therefore, it is possible for user to do initial trouble cleaning by himself/herself without skilled person's assistance. Besides, when the production apparatus 1 is stopped as the sheet 4 is involved into the heating roller 2, the contact-type separating structure 30 separates the sheet 4 and the heating roller 2 partially, so user can extract the involved sheet 4 from the separated part of the sheet 4. Therefore, the sheet separating mechanism A according to the present invention can further reduce difficulty of extracting the sheet 4, and maintenance time may be minimized.

Figure 4:
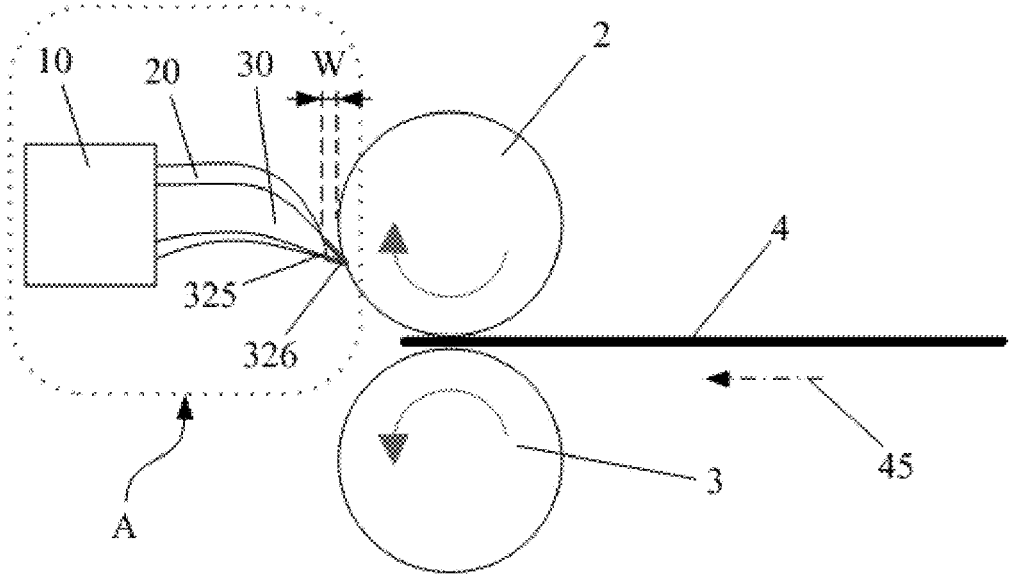
FIG. 4 is a schematic view of a first embodiment of a sheet separating mechanism in accordance with the present invention.
Figure 4:
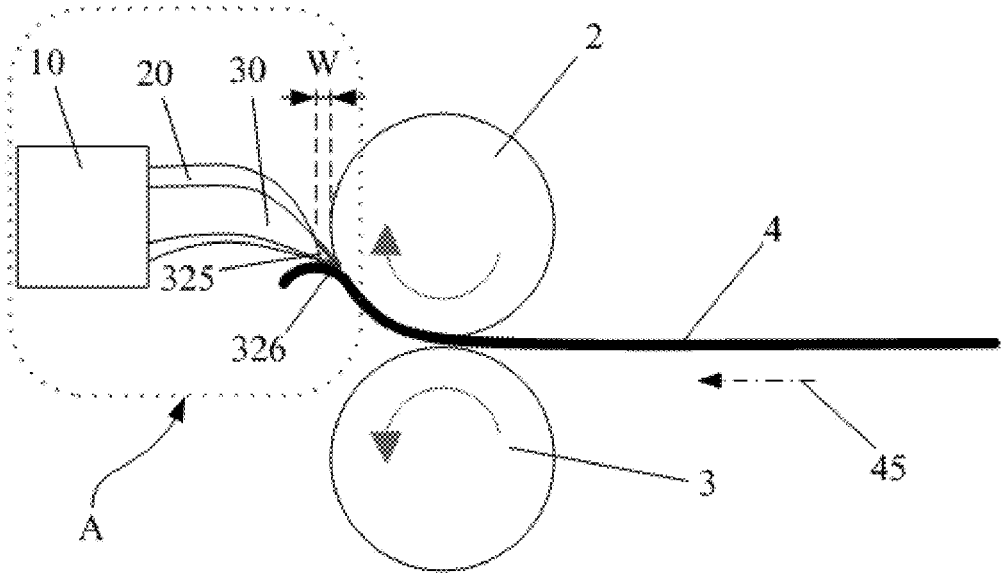

Please refer to FIG. 4 which is a schematic view of a first embodiment of a sheet separating mechanism in accordance with the present invention. The sheet separating mechanism A in the first embodiment is connected with the production apparatus 1 via the body 10 by assembly manner, so as to improve convenience in maintenance and trouble cleaning of the production apparatus 1. Please refer to (A) part of FIG. 4, the sheet 4 may move forward along the output direction 45 upon the operation of the heating module B. As shown in (B) part of FIG. 4, the sheet 4 may stick with surface of the heating roller 2 via the coatings on surface of the sheet 4 or be affected by high temperature, so the sheet 4 becomes deformed or curls toward the rotation direction of the heating roller 2 and does not move to outlet smoothly. The function of the sheet separating mechanism A can solve this problem. When the sheet 4 stuck with the heating roller 2 or deformed sheet 4 touches the tip part 325 of the contact-type separating structure 30 or the contactless separating structure 20, said sheet 4 can be peeled from the heating roller 2 first and further be removed from the surface of the heating roller 2. Preferably, the sheet 4 may touch the tip part 325 and the contactless separating structure 20 in order along the output direction 45. A thermal resistance polymer material 326 can be covered on the surface of the tip part 325 for protection.

Figure 5:
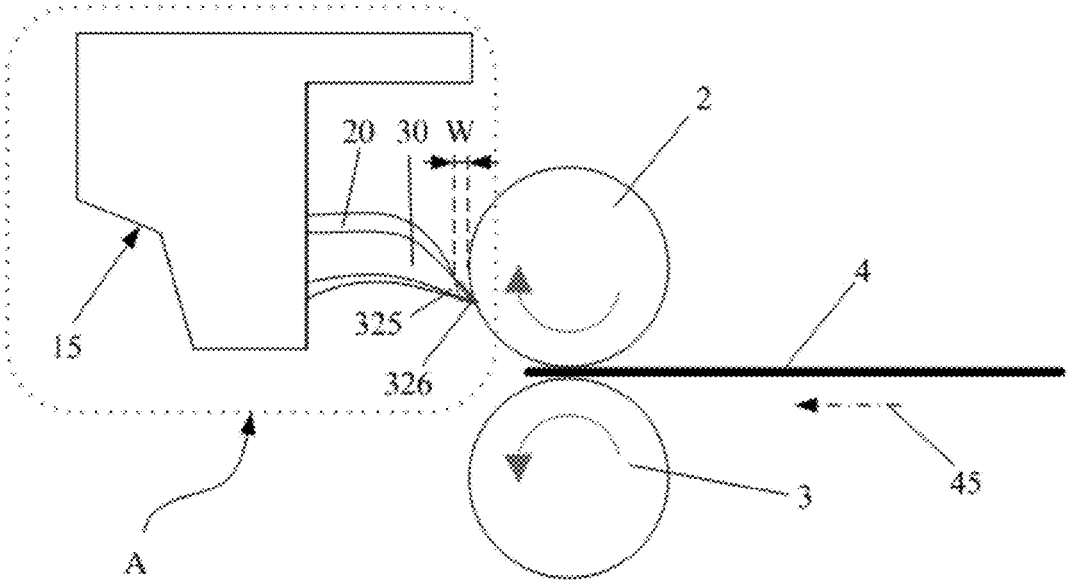
FIG. 5 is a schematic view of a second embodiment of a sheet separating mechanism in accordance with the present invention.
Figure 5:
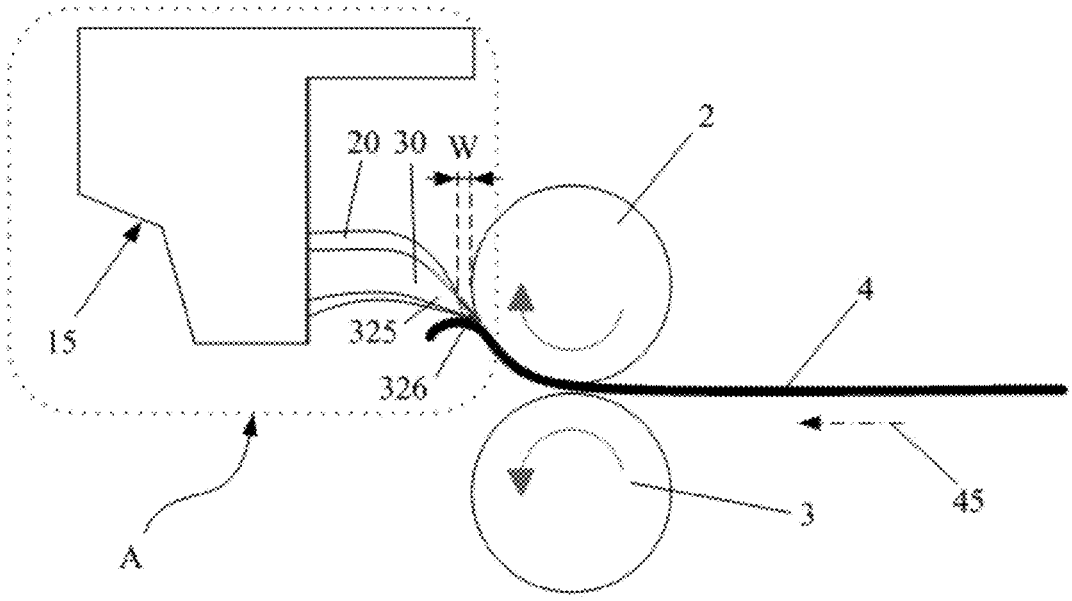

Please refer to FIG. 5 which is a schematic view of a second embodiment of a sheet separating mechanism in accordance with the present invention. In the second embodiment of the present invention, casing 15 of the production apparatus 1 is extended to connect the contactless separating structure 20 for replacing the connecting part 31 of the contact-type separating structure 30. This embodiment has an advantage that the casing 15, the contactless separating structure 20, and the connecting part 31 of the contact-type separating structure 30 can be manufactured by a process of integral formation, causing the time cost of assembly working procedure reduced and the quantity of stock for components further minimized. In this embodiment, the contactless separating structure 20 and the contact-type separating structure 30 are independently connected to the casing 15. Also, the contactless separating structure 20 and the contact-type separating structure 30 are directly connected to the casing 15 respectively. The operation principle of this embodiment is the same as the first embodiment, so the detail description is omitted.

The sheet separating mechanism of the present invention not only can be applied on traditional office business machine, but also on the transfer machine for cloth. The combination of the contactless separating structure and contact-type separating structure can solve the problem caused by single type separating structure. For example, if all separating structures are contact-type, the cost may be too high and too many contactless separating structures are easy to damage the heating roller and reduce usage life of the heating roller. However, if all separating structures are contactless, how to adjust the distance between the contactless separating structure and the heating roller is a problem. If the distance is too short, the contactless separating structure is easy to become deformed or deteriorative; otherwise, if the distance is too far, the contactless separating structure is hard to separate thinner sheet. Besides, if any part of the sheet is not separated from the heating roller, it is difficult for user to fix the sheet jam problem without additional assistance.

Moreover, the sheet separating mechanism of the present invention can decrease the using amount of the contact-type separating structure, which results in reducing the manufacturing cost of components, using fewer thermal resistance polymer material, and decreasing the probability of scratched damage to the surface of the heating roller due to direct touch of the contact-type separating structure. Therefore, the usage life of important components including the heating roller can be extended.

Although a few embodiments have been described, those skilled in the art will readily appreciate that many modifications are possible in the embodiments without materially departing from the novel teachings and advantages of the invention. While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A sheet separating mechanism, disposed on an output direction of a heating roller of a production apparatus, the sheet separating mechanism comprising:

a body, disposed in the production apparatus;

a contactless separating structure, disposed on the body and spaced from the heating roller by a preset distance; and a contact-type separating structure, having a connecting part and a contact part, and the connecting part being connected with the body, and the contact part contacting the heating roller; wherein when a sheet is moved by the rotating heating roller, the sheet is separated from the heating roller upon contact with the contact part and the contactless separating structure, wherein the contactless separating structure and the contact-type separating structure are independently connected to the body.

2. The sheet separating mechanism of claim 1, wherein material of the contact part is a thermal resistance polymer material, and the thermal resistance polymer material comprises polyimide (PI) or polyphenylene sulfide (PPS).

3. The sheet separating mechanism of claim 1, wherein the contact part and the connecting part are assembled or formed integrally.

4. The sheet separating mechanism of claim 3, wherein the contact part and the connecting part are integrally formed, and the material of the contact part and the connecting part is a thermal resistance polymer material, and the thermal resistance polymer material comprises polyimide (PI) or polyphenylene sulfide (PPS).

5. The sheet separating mechanism of claim 3, wherein the contact part and the connecting part are integrally formed, a thermal resistance polymer material is covered on surface of the contact part, and the thermal resistance polymer material comprises polyimide (PI) or polyphenylene sulfide (PPS).

6. The sheet separating mechanism of claim 1, wherein the preset distance is ranged from 0.2 millimeter to 1.0 millimeter.

7. The sheet separating mechanism of claim 1, wherein the sheet touches the contact part and the contactless separating structure in sequence along the output direction.

8. The sheet separating mechanism of claim 1, wherein the sheet comprises a paper sheet, a slide or a cloth.

9. The sheet separating mechanism of claim 1, wherein the production apparatus comprises a business machine or a transfer machine.

10. The sheet separating mechanism of claim 1, wherein the contactless separating structure and the contact-type separating structure are directly connected to the body respectively.

11. A sheet separating mechanism, disposed on an output direction of a heating roller of a production apparatus, the sheet separating mechanism comprising:

a contactless separating structure, formed by extending from a casing of the production apparatus and spaced from the heating roller by a preset distance; and a contact-type separating structure, having a connecting part and a contact part, and the connecting part formed by extending from the casing of the production apparatus, and the contact part contacting the heating roller; wherein when a sheet is moved by the rotating heating roller, the sheet is separated from the heating roller upon contact with the contact part and the contactless separating structure, wherein the contactless separating structure and the contact-type separating structure are independently connected to the casing.

12. The sheet separating mechanism of claim 11, wherein material of the contact part is a thermal resistance polymer material, and the thermal resistance polymer material comprises polyimide (PI) or polyphenylene sulfide (PPS).

13. The sheet separating mechanism of claim 11, wherein the contact part and the connecting part are assembled or formed integrally.

14. The sheet separating mechanism of claim 13, wherein the contact part and the connecting part are integrally formed, and the material of the contact part and the connecting part is a thermal resistance polymer material, and the thermal resistance polymer material comprises polyimide (PI) or polyphenylene sulfide (PPS).

15. The sheet separating mechanism of claim 13, wherein the contact part and the connecting part are integrally formed, a thermal resistance polymer material is covered on surface of the contact part, and the thermal resistance polymer material comprises polyimide (PI) or polyphenylene sulfide (PPS).

16. The sheet separating mechanism of claim 11, wherein the preset distance is ranged from 0.2 millimeter to 1.0 millimeter.

17. The sheet separating mechanism of claim 11, wherein the sheet touches the contact part and the contactless separating structure in sequence along the output direction.

18. The sheet separating mechanism of claim 11, wherein the sheet comprises a paper sheet, a slide or a cloth.

19. The sheet separating mechanism of claim 11, wherein the production apparatus comprises a business machine or a transfer machine.

20. The sheet separating mechanism of claim 11, wherein the contactless separating structure and the contact-type separating structure are directly connected to the casing respectively.

21. The sheet separating mechanism of claim 11, wherein the contactless separating structure, the contact-type separating structure and the casing are integrally formed.

* * * * *